US011353207B2

(12) United States Patent
Murayama et al.

(10) Patent No.: US 11,353,207 B2
(45) **Date of Patent: *Jun. 7, 2022**

(54) LIGHT SOURCE DEVICE

(71) Applicant: HAMAMATSU PHOTONICS K.K., Hamamatsu (JP)

(72) Inventors: Kyoichi Murayama, Hamamatsu (JP); Yoshiteru Miyamoto, Hamamatsu (JP); Hiroya Kashiwabara, Hamamatsu (JP); Ryotaro Matui, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/097,135

(22) Filed: Nov. 13, 2020

(65) Prior Publication Data

US 2021/0063008 A1 Mar. 4, 2021

Related U.S. Application Data

(62) Division of application No. 16/285,468, filed on Feb. 26, 2019, now Pat. No. 10,865,971.

(30) Foreign Application Priority Data

Feb. 28, 2018 (JP) ..... JP2018-035465

(51) Int. Cl.
*F21V 29/67* (2015.01)
*F21V 29/70* (2015.01)
(Continued)

(52) U.S. Cl.
CPC ..... *F21V 29/677* (2015.01); *F21V 29/673* (2015.01); *F21V 29/70* (2015.01); *B05D 3/067* (2013.01); *F21Y 2115/10* (2016.08)

(58) Field of Classification Search
CPC ..... F21V 29/83; F21V 23/009; F21V 15/01; F21V 29/67; F21V 29/763
(Continued)

(56) References Cited

U.S. PATENT DOCUMENTS 9,190,591 B2 * 11/2015 Tahara ..... H01L 33/645
2014/0376221 A1 * 12/2014 Eliason ..... B05D 3/067 362/235
(Continued)

FOREIGN PATENT DOCUMENTS

JP H11-113111 A 4/1999
JP 3102860 B2 10/2000
(Continued)

*Primary Examiner* — William J Carter
(74) *Attorney, Agent, or Firm* — Faegre Drinker Biddle & Reath LLP

(57) ABSTRACT

A light source device includes a casing including one end surface, other end surface, and one side surface between the one end surface and the other end surface, a light emitting unit provided on a side of the one end surface in the casing, a heat radiating unit provided in the casing and thermally connected to the light emitting unit, an exhaust port formed at least in a region located in one side surface and facing the heat radiating unit, an axial fan which is provided in the casing and supplies cooling air to the heat radiating unit, and a shielding deflecting plate which is provided between the axial fan and the heat radiating unit and shields a part of the cooling air supplied from the axial fan and deflects a part of the cooling air to a direction away from the exhaust port.

9 Claims, 10 Drawing Sheets

(51) Int. Cl.
*F21Y 115/10* (2016.01)
*B05D 3/06* (2006.01)

(58) Field of Classification Search
USPC ..... 362/373
See application file for complete search history.

(56) References Cited

U.S. PATENT DOCUMENTS

| | | | | |
|---|---|---|---|---|
| 2016/0018095 | A1* | 1/2016 | Deshpande | F21V 29/83 362/373 |
| 2016/0290608 | A1* | 10/2016 | Ohashi | F21V 19/003 |

FOREIGN PATENT DOCUMENTS

| | | | |
|---|---|---|---|
| JP | 2011-37025 | A | 2/2011 |
| JP | 2014-207411 | A | 10/2014 |
| JP | 2015-026757 | A | 5/2015 |
| JP | 2015-103335 | A | 6/2015 |
| JP | 2016-531732 | A | 10/2016 |
| WO | WO-2014/205107 | A1 | 12/2014 |
| WO | WO-2015/076258 | A1 | 5/2015 |

* cited by examiner

100

LIGHT SOURCE DEVICE

CROSS-REFERENCE TO RELATED APPLICATIONS

This application is a Divisional Application of U.S. patent application No. 16/285,468, filed Feb. 26, 2019, which claims the benefit of Japanese Patent Application No. 2018-035465, filed Feb. 28, 2018, the entire contents of which are incorporated herein by reference.

TECHNICAL FIELD

One aspect of the present invention relates to a light source device.

BACKGROUND

As a technique related to a light source device, for example, Japanese Unexamined Patent Publication No. 2016-531732 discloses a lighting module including a light emitting element array (light emitting unit), a heat sink (heat radiating unit) thermally coupled to the light emitting element array, a casing including the light emitting element array, and a plurality of heat discharge ports provided in the casing. In the lighting module disclosed in Japanese Unexamined Patent Publication No. 2016-531732, heat of the light emitting element array is diffused by the heat sink, and air having the heat is discharged to the outside of the casing through the heat discharge ports.

SUMMARY

In the light source device, as described above, the heat of the light emitting unit is diffused by the heat radiating unit, and the light emitting unit is cooled. However, there is still room for improvement to uniformly cool the light emitting unit. For example, if the light emitting unit cannot be uniformly cooled, a light emitting efficiency of the light emitting unit is not uniformed due to the effect of the heat, and in addition, there are some cases where an irradiation intensity is not uniform.

Therefore, an object of one aspect of the present invention is to provide a light source device capable of uniformly cooling a light emitting unit.

A light source device according to one aspect of the present invention includes a casing including one end surface, other end surface, and one side surface between the one end surface and the other end surface, a light emitting unit provided on a side of the one end surface in the casing, a heat radiating unit provided in the casing and thermally connected to the light emitting unit, an exhaust port formed at least in a region located in the one side surface and facing the heat radiating unit, an axial fan which is provided in the casing and supplies cooling air to the heat radiating unit, and a shielding deflecting plate which is provided between the axial fan and the heat radiating unit and shields a part of the cooling air supplied from the axial fan and deflects a part of the cooling air to a direction away from the exhaust port.

In the light source device, the cooling air is supplied from the axial fan to the heat radiating unit, and heat of the light emitting unit is diffused by the heat radiating unit. The cooling air having the heat is exhausted from an exhaust port in a region located in one side surface of the casing and facing the heat radiating unit. At this time, the shielding deflecting plate can prevent the cooling air supplied to the heat radiating unit from being immediately flowed toward the exhaust port, and the cooling air can be spread to the entire heat radiating unit. Therefore, according to the present invention, the light emitting unit can be uniformly cooled.

In the light source device according to one aspect of the present invention, the shielding deflecting plate may be arranged to extend at an angle which is not parallel to an axial direction of the axial fan. With this structure, it is possible to effectively realize the shielding and the deflection of the part of the cooling air by the shielding deflecting plate.

In the light source device according to one aspect of the present invention, the shielding deflecting plate may be arranged at the angle with which a direction of the cooling air toward one end surface is deflected to a side of another side surface facing the one side surface. As a result, the cooling air can be sufficiently spread to the entire heat radiating unit.

In the light source device according to one aspect of the present invention, the axial fan may include an impeller including a hub and a plurality of blades provided around the hub, and the shielding deflecting plate may be arranged to cover the side of the exhaust port of the axial fan as viewed from an axial direction of the axial fan and may have a width longer than a length from a base end to a front end of the blade. With this structure, it is possible to effectively realize the shielding and the deflection of the part of the cooling air by the shielding deflecting plate.

In the light source device according to one aspect of the present invention, the shielding deflecting plate may be provided to be extended from a mounting plate attached to a side of one end surface of the axial fan. With this structure, the shielding deflecting plate can be attached between the axial fan and the heat radiating unit by using the axial fan.

In the light source device according to one aspect of the present invention, the axial fan may be fixed to the fixing plate, and the mounting plate may clamp the axial fan in cooperation with the fixed plate. As a result, the mounting plate, and in addition, the shielding deflecting plate can be securely attached.

In the light source device according to one aspect of the present invention, the axial fans may be arranged in the casing side by side, and the single shielding deflecting plate may be provided between the plurality of axial fans and the heat radiating unit and may shield the part of the cooling air supplied from the plurality of axial fans and deflects the part of the cooling air to a direction away from the exhaust port. Accordingly, it is possible to prevent resonance of the shielding deflecting plate caused by the effect of vibration of the axial fan.

In the light source device according to one aspect of the present invention, the exhaust port may be formed in a region other than the side of the one end surface of the region located in the one side surface of the casing and facing the heat radiating unit. With this structure, the direction of the exhaust air exhausted to the outside of the casing via the exhaust ports can be directed toward the other end surface.

The light source device according to one aspect of the present invention may include a rectifying plate which extends from the periphery of the exhaust port in the one side surface toward the one end surface in the casing and is inclined with respect to the one side surface. With this structure, the direction of the exhaust air exhausted to the outside of the casing via the exhaust ports can be directed toward the other end surface.

In the light source device according to one aspect of the present invention, the exhaust port may be a hole formed in the one side surface, and the exhaust ports may be arranged in a honeycomb shape in the one side surface. With this structure, in a case where the plurality of exhaust ports is provided, a high opening ratio can be obtained while maintaining high rigidity.

In the light source device according to one aspect of the present invention, the axial fan may be arranged at a position where a distance to the heat radiating unit is equal to or shorter than a distance to the other end surface. In this case, for example, in comparison with a case where the axial fan is arranged on the side of the other end surface in the casing, it is possible to increase static pressure of the cooling air supplied to the heat radiating unit and reliably deflect the part of the cooling air by the shielding deflecting plate.

DETAILED DESCRIPTION

Figure 1:
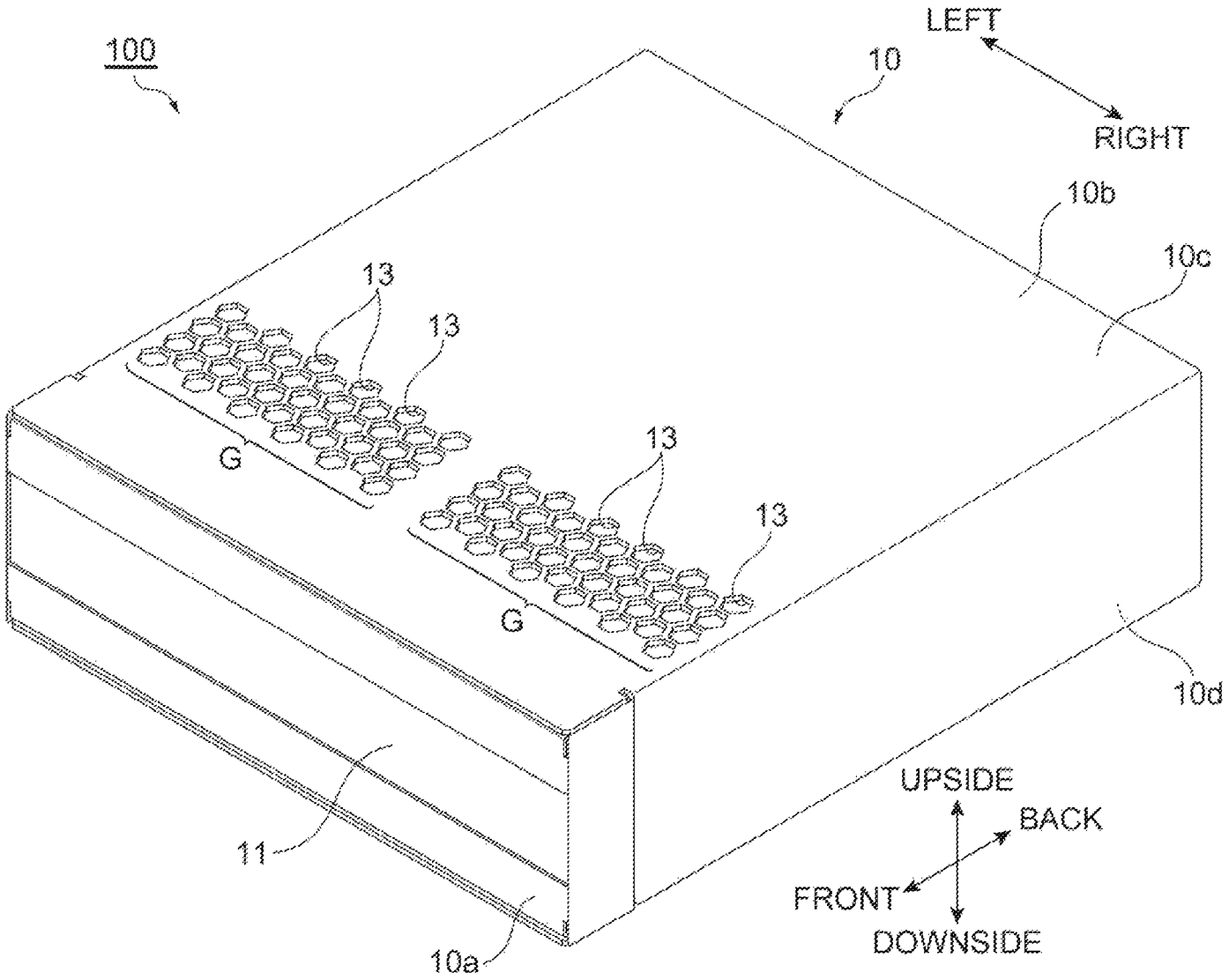
FIG. 1 is a perspective view of a light source device according to one embodiment.
Figure 2:
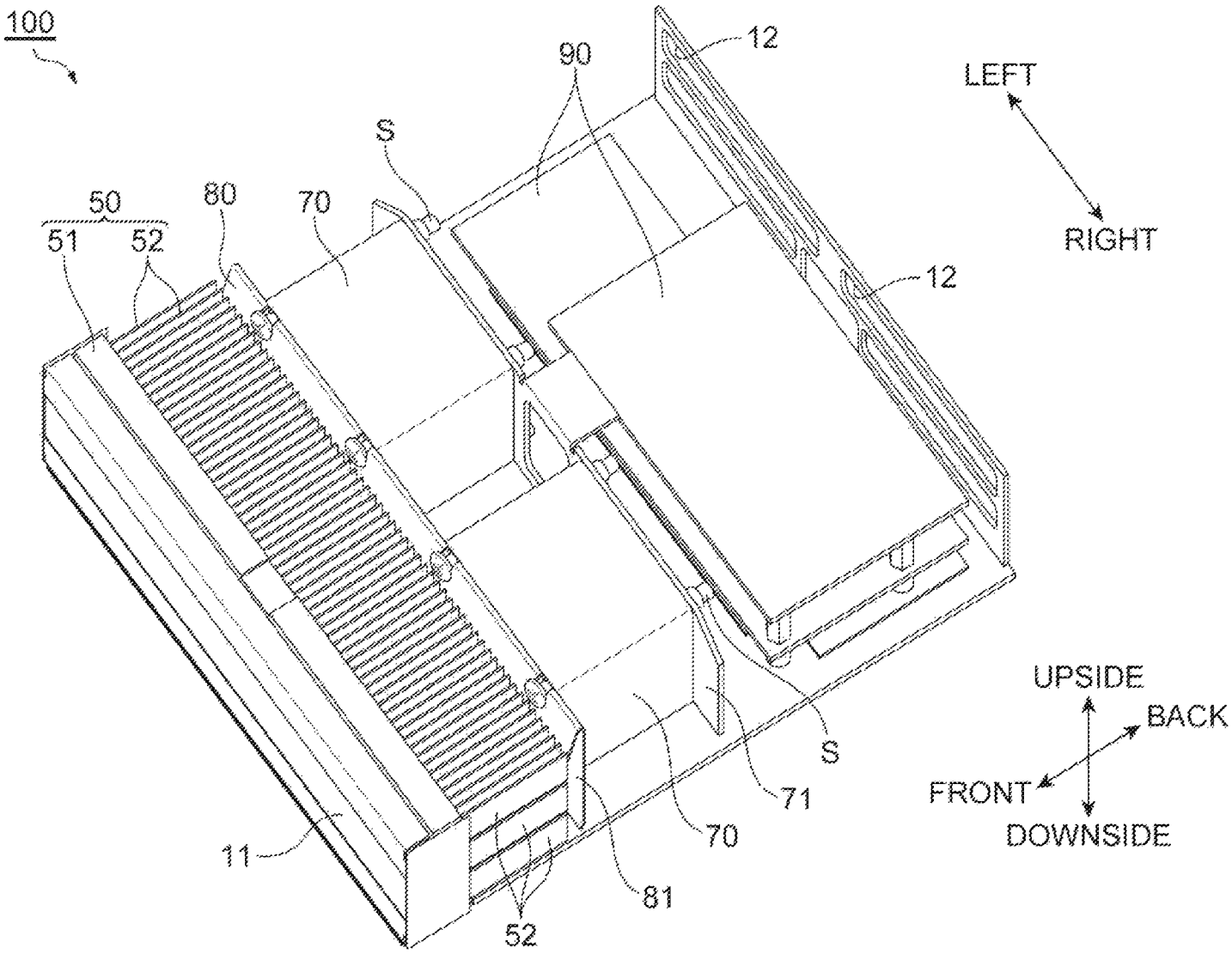
FIG. 2 is a perspective view of an interior of a casing of the light source device in FIG. 1.
Figure 3:
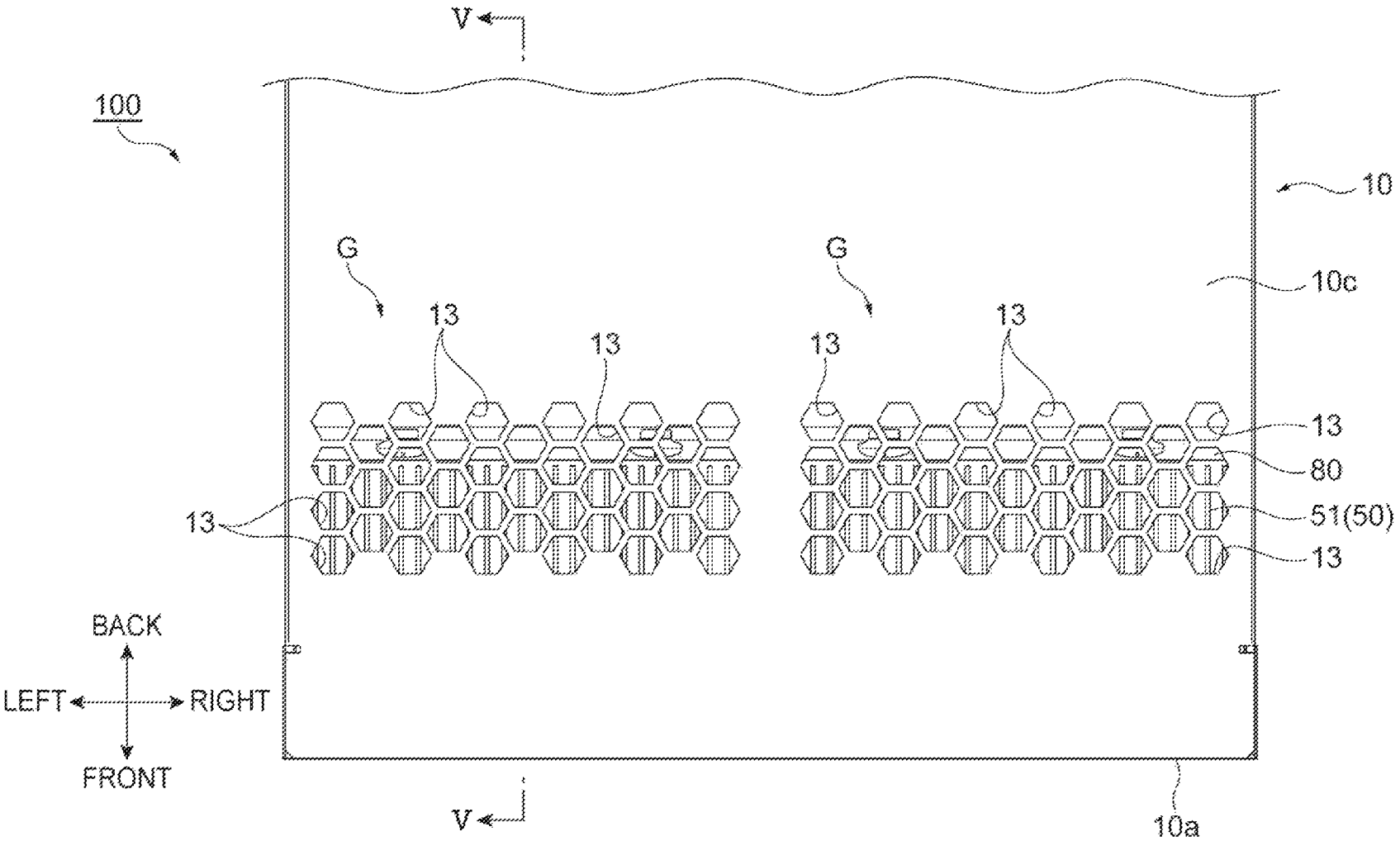
FIG. 3 is an enlarged plan view of a front side of the light source device in FIG. 1.

Hereinafter, an embodiment of the present invention will be described in detail with reference to the drawings. In the following description, the same or corresponding components are denoted with the same reference numeral, and overlapped description will be omitted.

As illustrated in FIGS. 1 to 4, a light source device 100 is, for example, a high-power air-cooled LED used for printing. The light source device 100 can be used as, for example, a light source unit mounted on a UV printing device (UV printer). The light source device 100 emits light such as ultraviolet light, for example, to dry ink. The light source device 100 includes a casing 10, an LED substrate 30, a heat sink 50, axial fans 70, a shielding deflecting plate 80, and a driver substrate 90.

For convenience of description, a side to which an LED element 32 of the LED substrate 30 (referred to as FIG. 5) emits light is referred to as a "front side", and the opposite side is referred to as a "rear side". A width direction of the light source device 100 (longitudinal direction of casing 10) which is a direction orthogonal to a light emitting direction of the LED element 32 is referred to as a "horizontal direction", and a direction orthogonal to a front-back direction and the horizontal direction is referred to as a "vertical direction".

The casing 10 is a rectangular box elongated in the horizontal direction. The casing 10 is formed of metal. The casing 10 houses the LED substrate 30, the heat sink 50, the axial fans 70, and the driver substrate 90. The casing 10 includes a front end surface (one end surface) 10*a* which is an end surface on the front side, a rear end surface (other end surface) 10*b* which is an end surface on the rear side, an upper surface (one side surface) 10*c* which is an upper side surface between the front end surface 10*a* and the rear end surface 10*b*, and a lower surface (another side surface) 10*d* which is a lower side surface between the front end surface 10*a* and the rear end surface 10*b*.

In the front end surface 10*a* of the casing 10, a light emitting window 11 for transmitting light emitted by the LED element 32 of the LED substrate 30 is provided. In the rear end surface 10*b* of the casing 10, an air intake port 12 for suctioning air from outside into the casing 10 is provided. A filter formed of, for example, urethane is attached to the air intake port 12.

In the upper surface 10*c* of the casing 10, exhaust ports 13 for exhausting air from inside of the casing 10 to the outside are provided. The exhaust port 13 is a hole which is formed in the upper surface 10*c* and communicates the inside and the outside of the casing 10. The exhaust port 13 is formed in a hexagonal shape. The exhaust ports 13 are arranged in a honeycomb shape in the upper surface 10*c*.

The exhaust ports 13 are formed at least in a region located in the upper surface 10*c* and facing the heat sink 50. Specifically, the exhaust ports 13 are formed in a region other than the front side in the region of the upper surface 10*c* facing the heat sink 50 (here, other than front half). That is, the exhaust ports 13 are formed at least in a rear side of the region located in the upper surface 10*c* and facing the heat sink 50 (here, rear half). In other words, the facing region is a region opposed to or facing the heat sink 50 or overlapped with the heat sink 50 when viewed from above. The exhaust port 13 exposes at least the rear half of the heat sink 50 when the upper surface 10*c* is viewed from the above and does not expose the front half of the heat sink 50.

In the illustrated example, the plurality of exhaust ports 13 is divided for each of the plurality of axial fans 70. That is, on the upper surface 10*c*, a plurality of exhaust port groups G formed by arranging the exhaust ports 13 in a honeycomb shape to be closer to each other is formed. In the horizontal direction, the exhaust port group G is arranged in a range which includes the single axial fan 70 and is wider than the single axial fan 70. The exhaust port group G is arranged in a range from the center of the heat sink 50 to the front end portion of the single axial fan 70 in the front-back direction.

Figure 4:
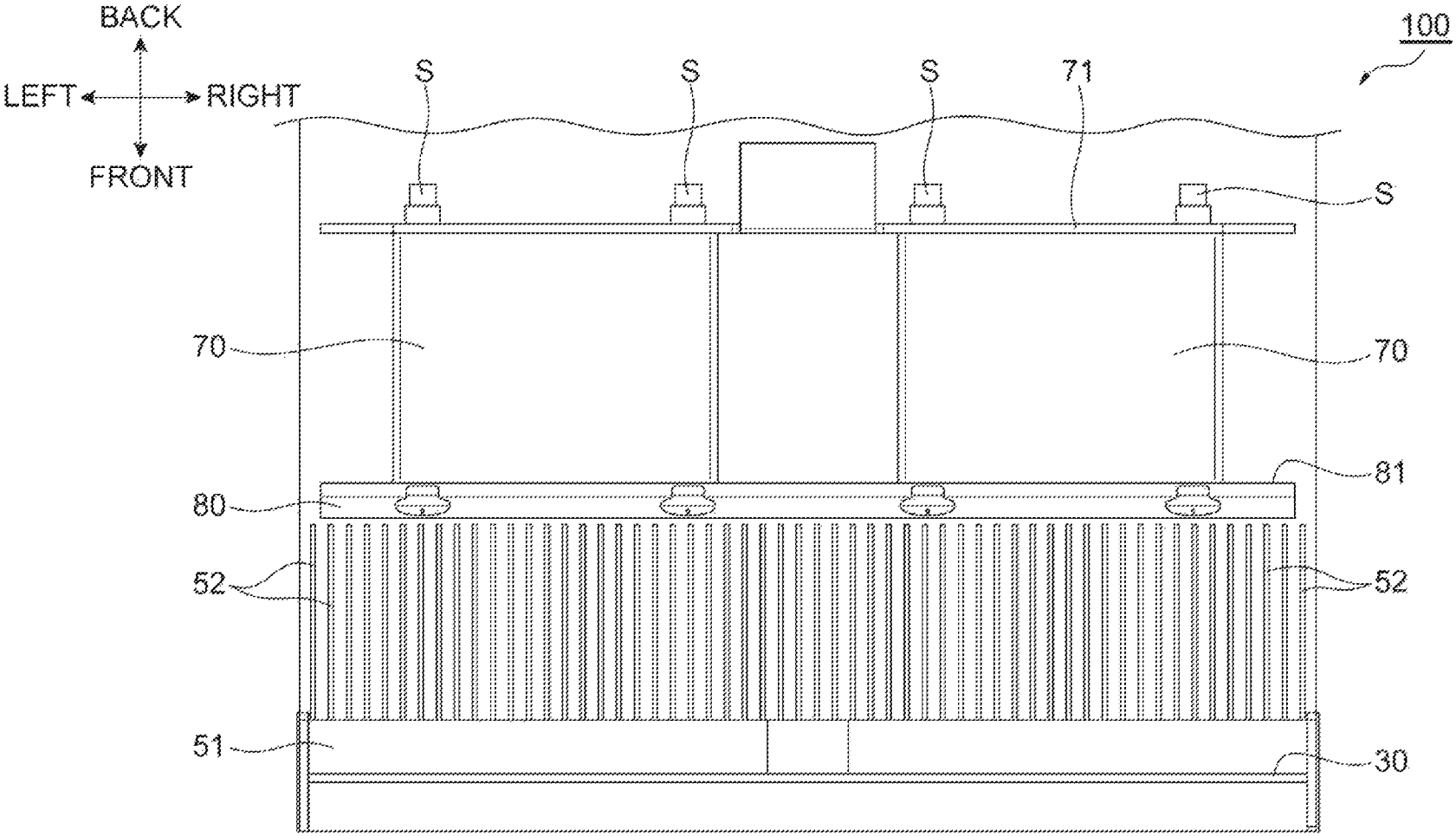
FIG. 4 is an enlarged plan view of a front side of the interior of the casing of the light source device in FIG. 1.
Figure 5:
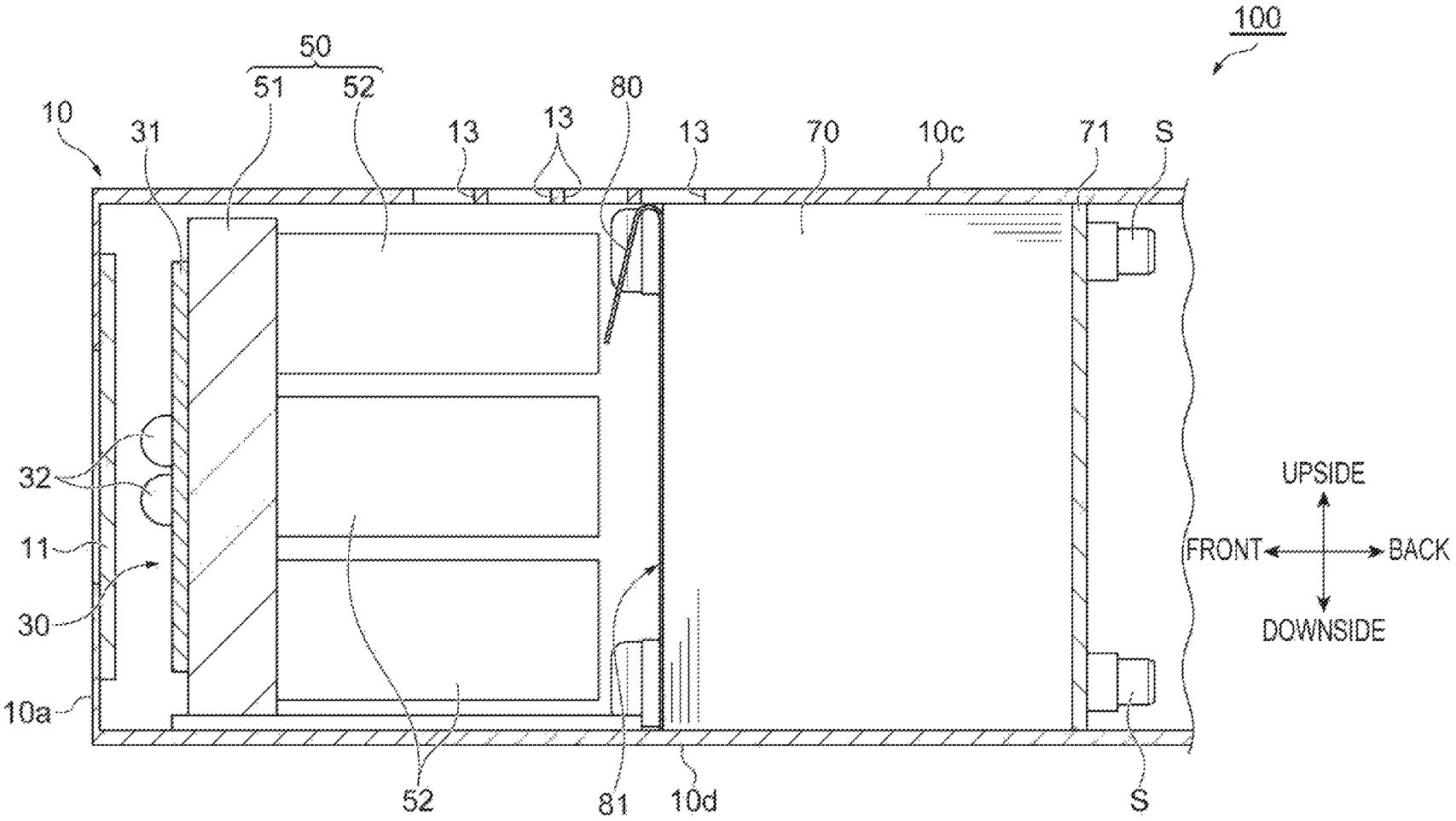
FIG. 5 is an enlarged cross-sectional view taken along a line V-V of FIG. 3.

As illustrated in FIGS. 4 and 5, the LED substrate 30 is a light emitting unit provided on a side of the front end surface 10*a* in the casing 10. The LED substrate 30 includes a rectangular plate-like substrate 31 forming a predetermined circuit and the LED elements 32 which are light emitting elements arranged side by side at a predetermined pitch in the vertical direction and the horizontal direction on the substrate 31. The LED element 32 emits light such as ultraviolet light forward. The LED substrate 30 may be divided into a plurality of parts in the horizontal direction and may be integrally formed. The LED substrate 30 extends in a region from the left end to the right end in the casing 10.

The LED substrate 30 is arranged on the front side in the casing 10 so that the LED element 32 faces the light emitting window 11 of the front end surface 10*a*. An irradiation object is irradiated with the light emitted from each LED element 32 of the LED substrate 30 via the light emitting window 11. As the irradiation object, for example, an object to which light (UV light) curing type ink or adhesive is attached can be exemplified.

The heat sink 50 is a heat radiating unit which is thermally connected to the LED substrate 30. The heat sink 50 is provided on the rear side of the LED substrate 30 in the casing 10. The heat sink 50 extends in a region from the left end to the right end in the casing 10. The heat sink 50 includes a base 51 having contact with the rear side of the LED substrate 30 (here, rear surface of substrate 31) and a plurality of heat radiating fins 52 erected on the rear side of the base 51.

The base 51 has a rectangular block shape elongated in the horizontal direction. A thickness direction of the heat radiating fin 52 is the horizontal direction, and the heat radiating fin 52 has a rectangular plate-like shape elongated in the front-back direction. The heat radiating fins 52 are arranged to be stacked in the horizontal direction with gaps therebetween. A plurality of stages of fin groups including the plurality of heat radiating fins 52 arranged to be stacked is provided along the vertical direction (three stages in illustrated example).

An axial direction of the axial fan 70 is the front-back direction, and the axial fan 70 suctions air from the rear side and pressure-feeds the air forward as cooling air. The axial fan 70 is provided in the casing 10 and supplies the cooling air to the heat sink 50. The axial fan 70 is arranged on the rear side of the heat sink 50. Specifically, the axial fan 70 is arranged at a position where the distance to the heat sink 50 is equal to or less than a distance to the rear end surface 10*b* of the casing 10. Here, the axial fan 70 is arranged at a position near the rear side of the heat sink 50 (a position with a slight gap). The axial fan 70 sends the cooling air from the rear side of the heat radiating fin 52 of the heat sink 50 to the front side.

The plurality of axial fans 70 (here, two) is used. The axial fans 70 are arranged side by side along the horizontal direction in the casing 10. In the illustrated example, the axial fans 70 are arranged at a position on the left side of the center in the horizontal direction and a position on the right side of the center. The rear side (rear surface) of the axial fan 70 has contact with a fixing plate 71 and is fixed to the fixing plate 71 with screw shafts S. The fixing plate 71 has an L-like shape as viewed from the horizontal direction. The fixing plate 71 is fixed to the upper surface 10*c* and the lower surface 10*d* of the casing 10. With this structure, the axial fan 70 is fixed to the casing 10 via the fixing plate 71.

Figure 7:
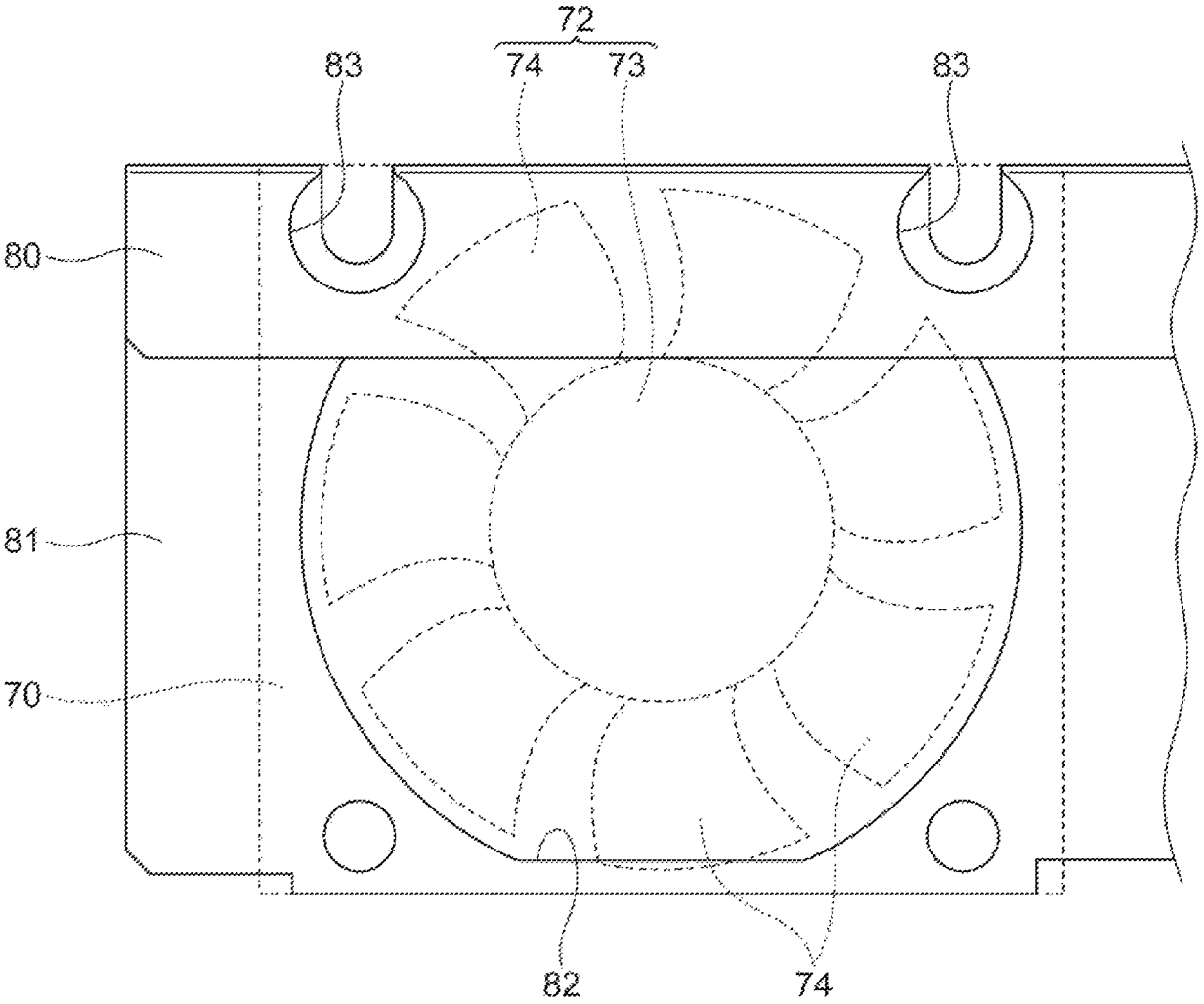
FIG. 7 is a front view of the shielding deflecting plate and the mounting plate of the light source device in FIG. 1.

As illustrated in FIG. 7, the axial fan 70 includes an impeller 72 which rotates by a driving force of a motor (not shown). The impeller 72 includes a hub 73 which is a rotation shaft and a plurality of blades 74 provided around the hub 73. The type, shape, size, form, specification, and the like of the axial fan 70 are not particularly limited, and various known axial fans can be used.

Figure 6:
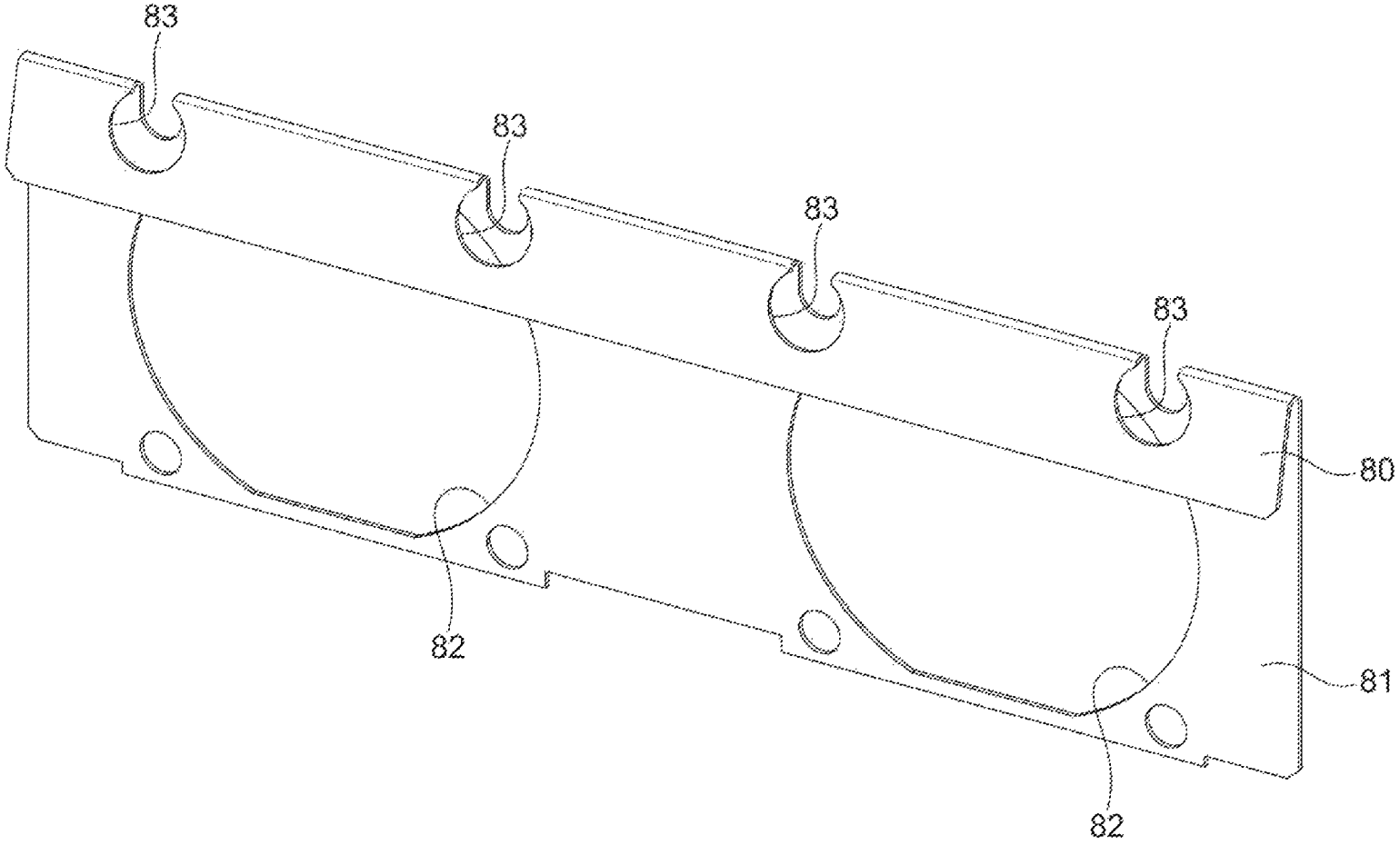
FIG. 6 is a perspective view of a shielding deflecting plate and a mounting plate of the light source device in FIG. 1.

As illustrated in FIGS. 5 to 7, the shielding deflecting plate 80 is provided between the axial fans 70 and the heat sink 50. The shielding deflecting plate 80 shields a part of the cooling air supplied from the axial fan 70 and deflects the cooling air to a lower side which is a direction away from the exhaust port 13. The shielding deflecting plate 80 is arranged so as to extend at an angle which is not parallel to (intersect with) the axial direction of the axial fan 70. The shielding deflecting plate 80 is arranged at an angle so as to deflect the direction of the cooling air moving forward to the side of the lower surface 10*d*. The shielding deflecting plate 80 extends straight in the horizontal direction and extends to intersect with the front-back direction and the vertical direction. The shielding deflecting plate 80 is inclined with respect to the vertical direction so as to be positioned on the front side as going down as viewed from the horizontal direction. As an example, in a case where a lower end of the shielding deflecting plate 80 is virtually extended, an angle of inclination of the shielding deflecting plate 80 is an angle formed by intersecting the shielding deflecting plate 80 with the lower surface 10*d* near the center of the heat sink 50 in the front-back direction.

The shielding deflecting plate 80 is arranged so as to cover a part of the upper side of the axial fan 70 as viewed from the front side. The shielding deflecting plate 80 has a rectangular plate-like shape of which a longitudinal direction is the horizontal direction. The shielding deflecting plate 80 has a vertical width equal to or longer than a length of the blade 74 from the base end to the front end (dimension of single blade 74 in radial direction) as viewed from the front side. That is, the shielding deflecting plate 80 has a vertical width with which at least the single blade 74 can be hidden. Here, the shielding deflecting plate 80 has a vertical width corresponding to a length from the base end to the front end of the blade 74 as viewed from the front side.

The shielding deflecting plate 80 is provided to be extended from a mounting plate 81 attached on the front side of the axial fan 70. The mounting plate 81 has a plate-like shape of which a thickness direction is the front-back direction. In the mounting plate 81, a plurality of openings 82 corresponding to air supply ports of the plurality of axial fans 70 is formed. The single mounting plate 81 is provided for the plurality of axial fans 70, has contact with a region of the front surface of each of the plurality of axial fans 70 other than the air supply port, and is fixed to each axial fan 70 with the screw shafts S. By fastening the screw shaft S, the mounting plate 81 clamps the axial fan 70 in the front-back direction in cooperation with the fixing plate 71.

The shielding deflecting plate 80 is continuous with an upper end of the mounting plate 81. After extending from the upper end to be curved forward, the shielding deflecting plate 80 inclines and extends to be positioned forward to going downward. A lower end of the shielding deflecting plate 80 is positioned at a position having contact with or substantially having contact with the heat sink 50, a position away from the heat sink 50 by a dimension tolerance, or a position slightly away from the heat sink 50. Through-holes 83 to avoid interference with the screw shafts S are formed in the shielding deflecting plate 80.

The single shielding deflecting plate 80 is provided with respect to the plurality of axial fans 70. That is, the single shielding deflecting plate 80 is provided between the plurality of axial fans 70 and the heat sink 50 and shields the part of the cooling air supplied from the plurality of axial fans 70 and deflects the part of the cooling air to a direction away from the exhaust ports.

The driver substrate 90 is a driving electric circuit substrate for driving the light source device 100. The driver substrate 90 is provided on the rear side than the axial fan 70 in the casing 10. The driver substrate 90 is arranged so that a main surface of the driver substrate 90 is positioned along the front-back direction.

In the light source device 100 described above, air is flowed into the casing 10 via the air intake port 12 of the rear end surface 10*b*. The air which has been flowed in is sent forward by the axial fan 70 in the casing 10 and is supplied as the cooling air from the rear side of the heat sink 50. In the heat sink 50, heat of the LED substrate 30 is diffused by the cooling air. Then, the cooling air having the heat is exhausted to the outside of the casing 10 via the exhaust ports 13.

Figure 8A:
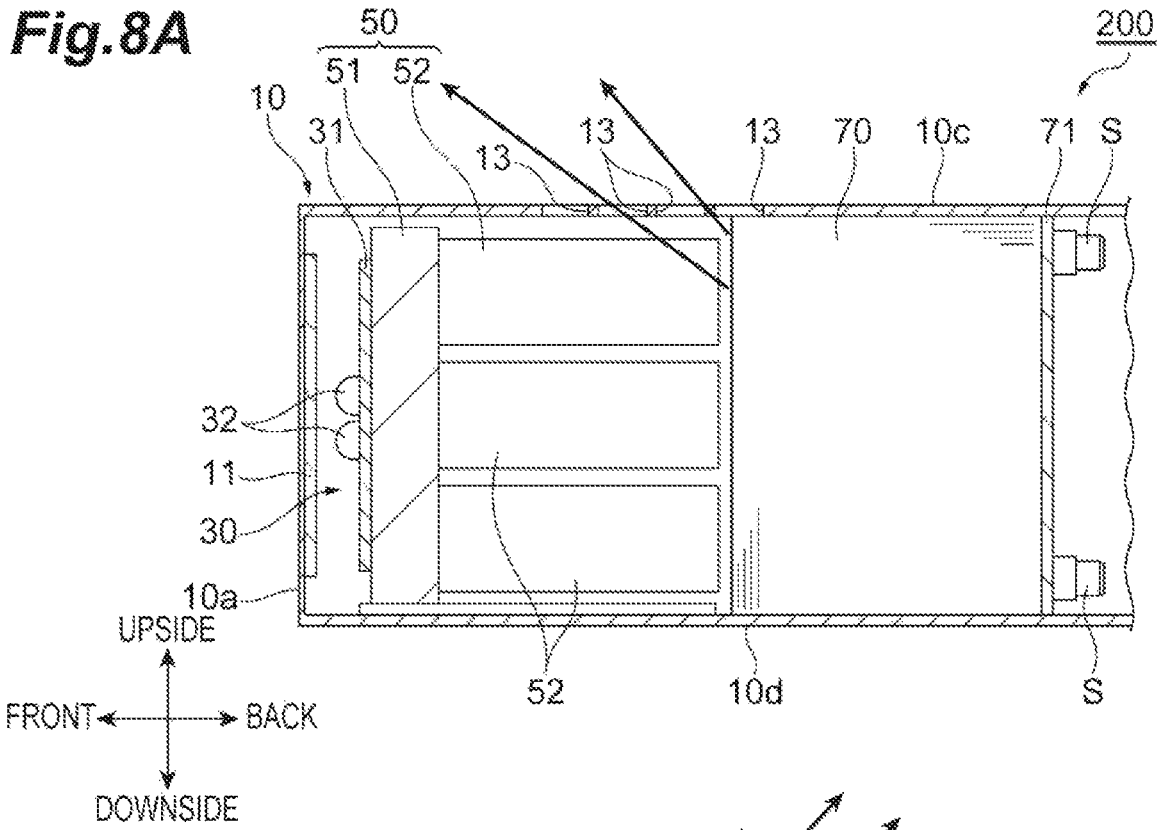
FIG. 8A is a schematic cross-sectional view for explaining an air flow of a light source device according to a comparative example.
Figure 8B:
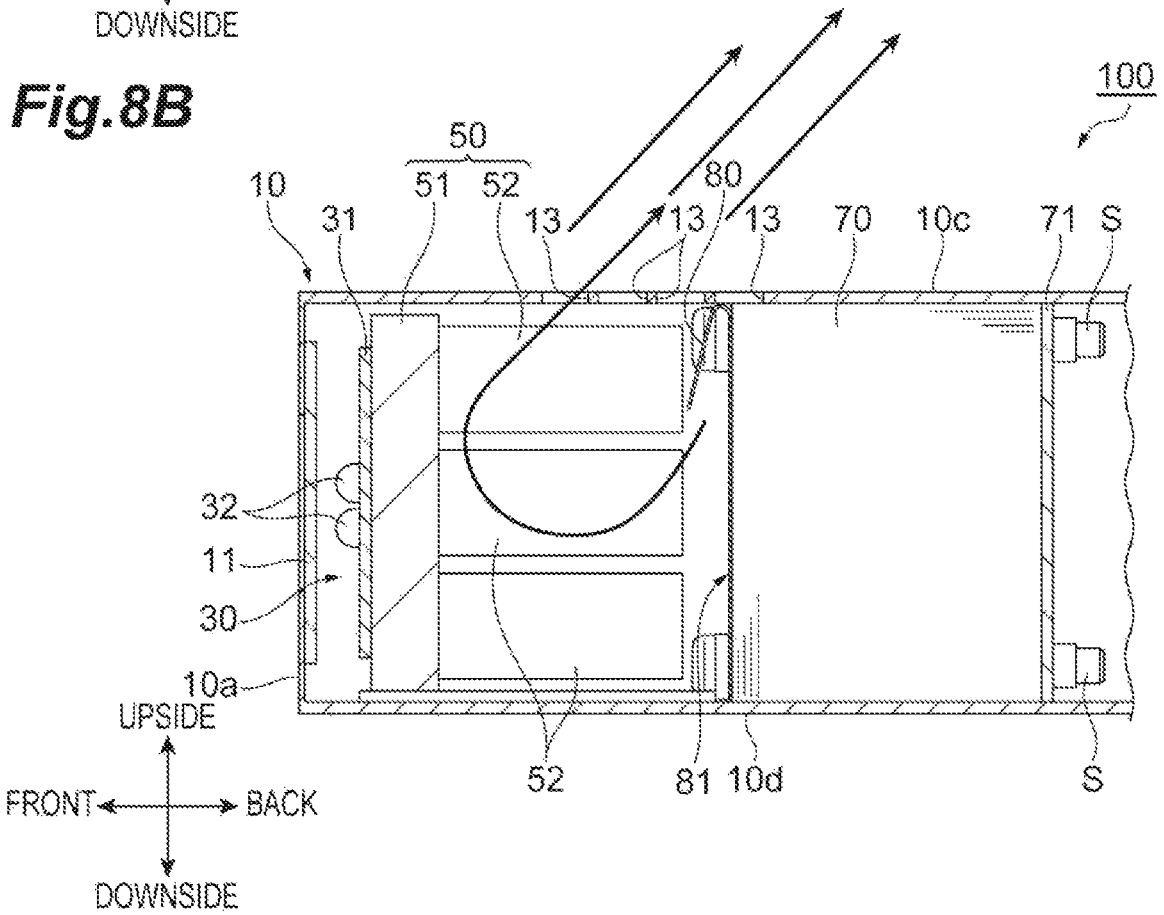
FIG. 8B is a schematic cross-sectional view for explaining an air flow of the light source device in FIG. 1.

FIG. 8A is a schematic cross-sectional view for explaining an air flow of a light source device 200 according to a comparative example. FIG. 8B is a schematic cross-sectional view for explaining an air flow of the light source device 100. The light source device 200 according to the comparative example is different from the light source device 100 in that the light source device 200 does not include the shielding deflecting plate 80. The axial fan 70 has a characteristic that the supplied cooling air expands radially outward. Therefore, as illustrated in the light source device 200 in FIG. 8A, the cooling air supplied from the axial fan 70 is easily flowed to the exhaust port 13 and hardly blows against the entire heat sink 50.

Whereas, as illustrated in FIG. 8B, in the light source device 100, the shielding deflecting plate 80 shields the part of the cooling air supplied from the axial fan 70 and deflects the part of the cooling air to a direction away from the exhaust port 13. This can reduce spread of the cooling air supplied from the axial fan 70 and prevent the cooling air supplied from the heat sink 50 from being immediately flowed toward the exhaust port 13. Specifically, as illustrated in FIG. 8B, a part of the upper side of the cooling air supplied from the axial fan 70 can be flowed toward the exhaust port 13 after turning the cooling air around to the lower side. As a result, the cooling air can be spread to the entire heat sink 50. Therefore, the light source device 100 can uniformly cool the LED substrate 30. It is possible that the cooling air supplied from the axial fan 70 is fully blown against the heat sink 50 to improve a cooling efficiency. Furthermore, in the light source device 100, it is possible to uniform a light emission efficiency of the LED substrate 30 and to uniform irradiation intensity (ultraviolet light irradiation intensity) of the LED substrate 30 by uniformly cooling the LED substrate 30. In particular, to realize the uniform irradiation intensity of the long light source device 100 (for example, equal to or longer than 100 mm), it is particularly effective to uniformly cool the LED substrate 30.

In the light source device 100, the shielding deflecting plate 80 is arranged so as to extend at an angle which is not parallel to the axial direction of the axial fan 70. This can effectively realize shielding and deflection of the part of the cooling air by the shielding deflecting plate 80.

In the light source device 100, the shielding deflecting plate 80 may be arranged at an angle with which the cooling air moving forward is deflected to the side of the lower surface 10*d*. As a result, the cooling air can be sufficiently spread to the entire heat sink 50.

In the light source device 100, the shielding deflecting plate 80 is arranged to cover the upper part of the axial fan 70 as viewed from the front side and has a width corresponding to the length from the base end to the front end of the blade 74 of the impeller 72 of the axial fan 70. With this structure, it is possible to effectively realize the shielding and the deflection of the part of the cooling air by the shielding deflecting plate 80.

In the light source device 100, the shielding deflecting plate 80 may be provided to be extended from the mounting plate 81 attached on the front side of the axial fan 70. With this structure, the shielding deflecting plate 80 can be attached between the axial fan 70 and the heat sink 50 by using the axial fan 70.

In the light source device 100, the axial fan 70 is fixed to the fixing plate 71. The mounting plate 81 clamps the axial fan 70 in cooperation with the fixing plate 71. As a result, the mounting plate 81, and in addition, the shielding deflecting plate 80 can be securely attached.

In the light source device 100, the axial fans 70 are arranged in the casing 10 side by side, and the single shielding deflecting plate 80 is provided between the plurality of axial fans 70 and the heat sink 50. The single shielding deflecting plate 80 shields and deflects the part of the cooling air supplied from the plurality of axial fans 70.

Accordingly, it is possible to prevent resonance of the shielding deflecting plate 80 caused by the effect of vibration of the axial fan 70 (for example, vibration caused by motor).

The exhaust ports 13 of the light source device 100 are arranged in the region located in the upper surface 10*c* and facing the heat sink 50 other than the front side. With this structure, a direction of the exhaust air exhausted to the outside of the casing 10 via the exhaust ports 13 can be controlled. That is, the exhaust air can be directed backward. Particularly, as illustrated in FIGS. 8A and 8B, in a case where the shielding deflecting plate 80 is not provided (in a case of light source device 200), the cooling air is exhausted to a direction in which the cooling air is easily flowed, and the direction of the exhaust air is easily directed forward (side of irradiation surface). In this point, in the light source device 100, the shielding deflecting plate 80 can prevent the cooling air from immediately being flowed toward the exhaust port 13, and an effect for directing the direction of the exhaust air backward is remarkable. It is not necessary to provide a duct component which directs the direction of the exhaust air backward, and the light source device 100 can be downsized and thinned.

In the light source device 100, the exhaust port 13 is a hole formed in the upper surface 10*c*, and the exhaust ports 13 are arranged in a honeycomb shape on the upper surface 10*c*. With this structure, in a case where the plurality of exhaust ports 13 is provided, a high opening ratio can be obtained while maintaining high rigidity.

In the light source device 100, the axial fan 70 is arranged at a position where the distance to the heat sink 50 is equal to or less than a distance to the rear end surface 10*b*. In this case, for example, in comparison with a case where the axial fan 70 is arranged on the side of the rear end surface 10*b* in the casing 10, it is possible to increase static pressure of the cooling air supplied to the heat sink 50 and to reliably realize deflection of the part of the cooling air by the shielding deflecting plate 80. By increasing the static pressure of the cooling air, effects can be reliably obtained that the cooling efficiency can be improved and the direction of the exhaust air is directed backward.

Figure 9:
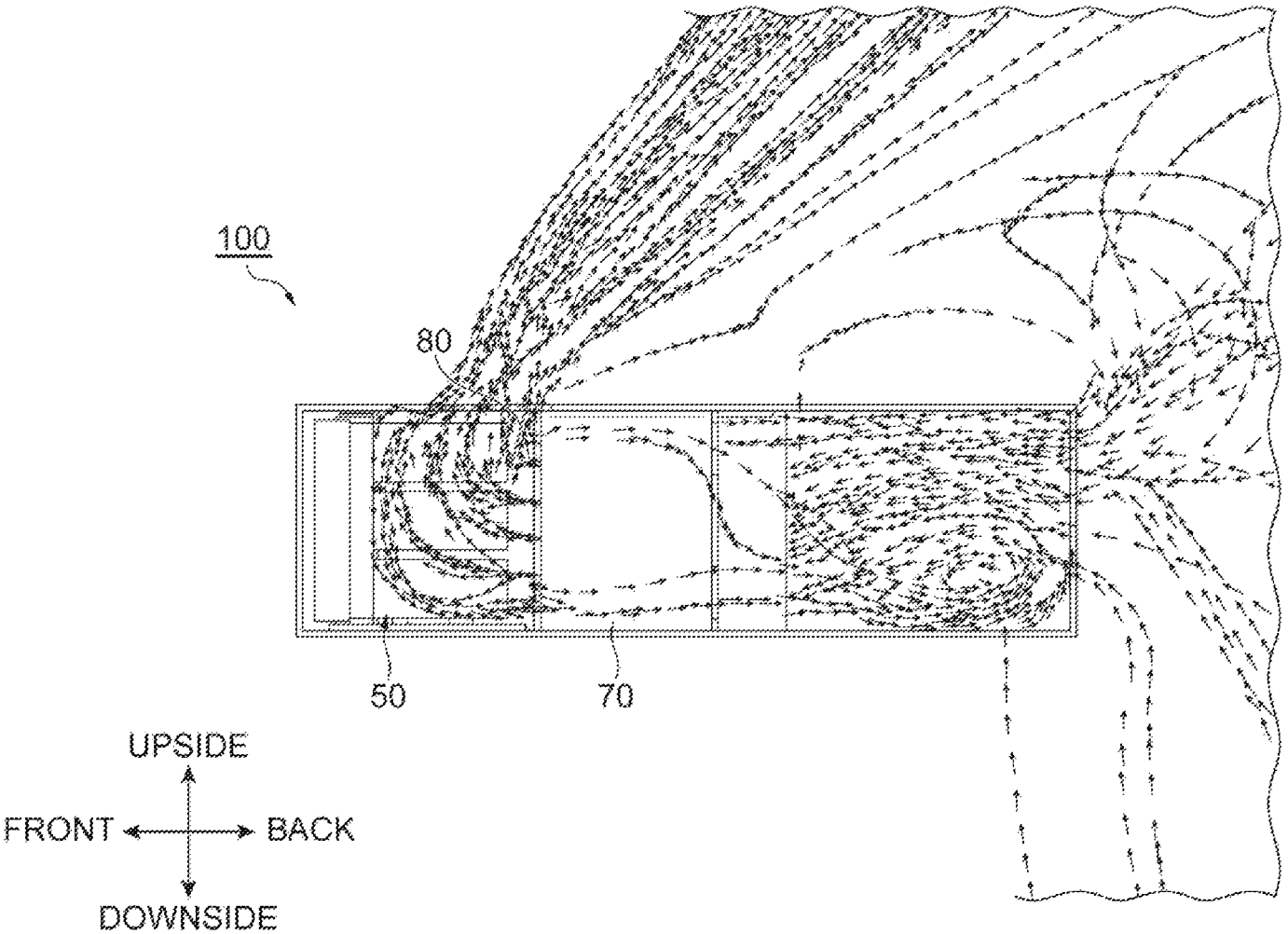
FIG. 9 is a cross-sectional view of a result of simulating the air flow of the light source device in FIG. 1.

FIG. 9 is a cross-sectional view of a result of simulating an air flow of the light source device 100. Lines illustrated in FIG. 9 are flow lines indicating the air flow. As illustrated in FIG. 9, according to the light source device 100, it can be confirmed that the cooling air supplied to the heat sink 50 can be prevented from being immediately flowed toward the exhaust port 13. It can be confirmed that the cooling air can be spread to the entire heat sink 50. It can be confirmed that the direction of the exhaust air can be directed backward.

As described above, one embodiment of the present invention is not limited to the above embodiment and may be a modification in a range without changing the gist of claims or an application to the other one.

Figure 10:
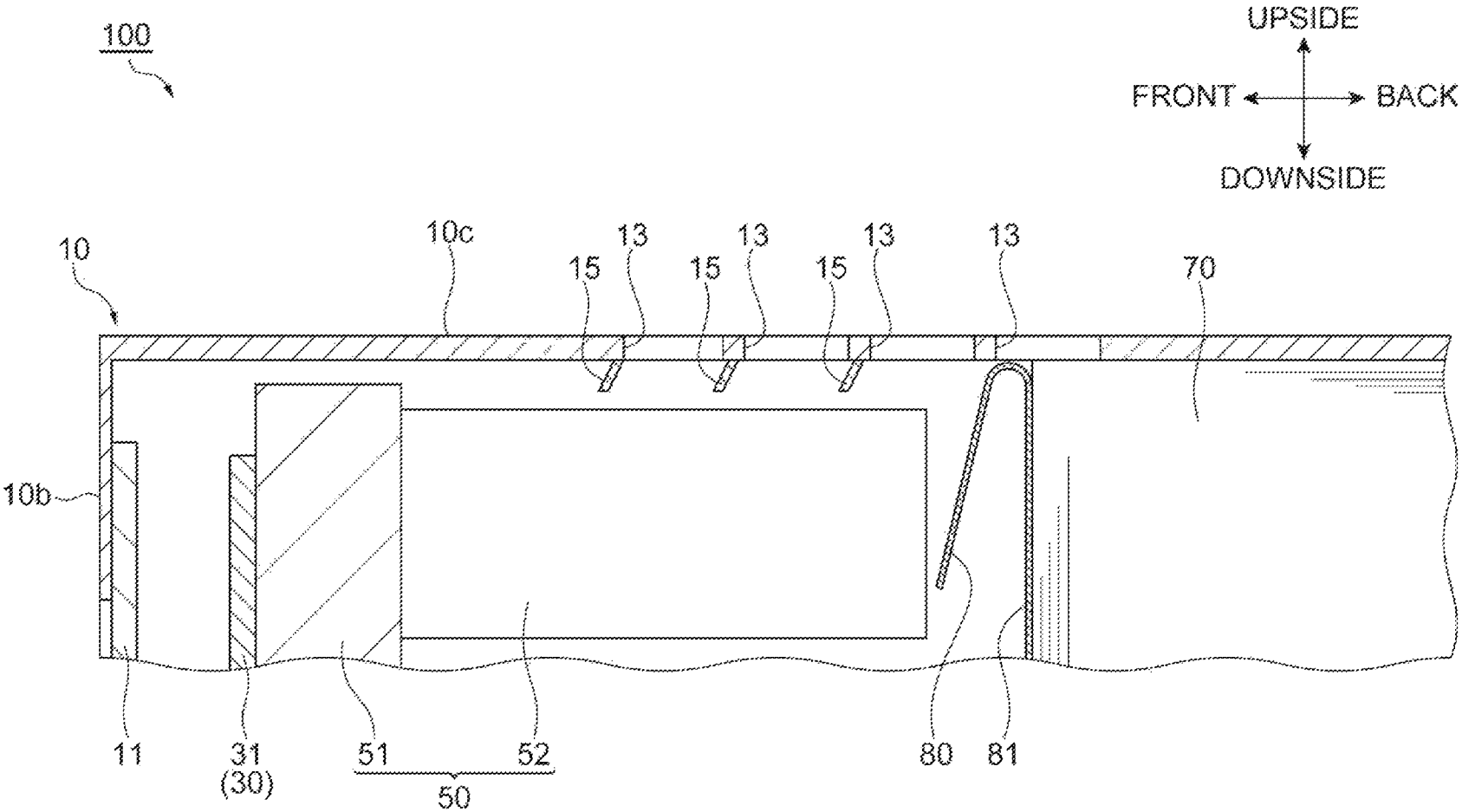
FIG. 10 is an enlarged cross-sectional view of a front side of a light source device according to a modification.

As illustrated in FIG. 10, the embodiment may include a rectifying plate 15 which extends from the periphery of the exhaust port 13 on the upper surface 10*c* toward the front side in the casing 10. The rectifying plate 15 is inclined with respect to the upper surface 10*c*. In the illustrated example, the rectifying plate 15 is a flat plate provided on the periphery of at least a part of the plurality of exhaust ports 13. With this structure, the direction of the exhaust air exhausted to the outside of the casing 10 via the exhaust ports 13 can be directed backward.

In the embodiment, the single shielding deflecting plate 80 is provided between the plurality of axial fans 70 and the heat sink 50. However, the present invention is not limited to this. The shielding deflecting plate 80 and the plurality of axial fans 70 may be separately provided. That is, for example, in a case where the two axial fans 70 are provided, the shielding deflecting plate 80 may be divided into two parts.

In the embodiment, the single heat sink 50 elongated in the horizontal direction is provided. However, the present invention is not limited to this. The embodiment may include the plurality of heat sinks arranged along the horizontal direction. In the embodiment, the shape and the number of the exhaust ports 13 are not particularly limited. The exhaust port 13 may have various shapes, and any number of exhaust ports 13 may be used. In the embodiment, the position of the exhaust port 13 in the upper surface 10*c* is not particularly limited. It is preferable that the exhaust port 13 be formed at least in the region located in the upper surface 10*c* and facing the heat sink 50.

In the heat sink 50 according to the embodiment, the plurality of fin groups including the plurality of heat radiating fins 52 arranged to be stacked in the horizontal direction is provided along the vertical direction. However, a fin structure of the heat sink 50 is not particularly limited, and various fin structures can be adopted. For example, in the heat sink 50, a single plate-like heat radiating fin may be arranged to be stacked in the horizontal direction. That is, a fin structure may be used in which the fin group including the plurality of heat radiating fins 52 arranged to be stacked in the horizontal direction is not vertically divided.

In the embodiment, the light emitting unit is not particularly limited to the LED substrate 30, and, for example, a known light emitting element may be used instead of the LED element 32. In the embodiment, the heat radiating unit is not particularly limited to the heat sink 50, and other various heat radiating units may be used. In the embodiment, the usage of the light source device 100 is not particularly limited and can be used to dry adhesive and the like.

According to one aspect of the present invention, a light source device capable of uniformly cooling a light emitting unit can be provided. By uniformly cooling the light emitting unit, the irradiation intensity can be uniformed.

What is claimed is:

1. A light source device comprising:

a casing including one end surface, other end surface, and one side surface between the one end surface and the other end surface;

a light emitting unit provided on a side of the one end surface in the casing;

a heat radiating unit provided in the casing and thermally connected to the light emitting unit;

an exhaust port formed at least in a region located in the one side surface and facing the heat radiating unit;

an axial fan configured to be provided in the casing and supply cooling air to the heat radiating unit; and a shielding deflecting plate configured to be provided between the axial fan and the heat radiating unit and shield a part of the cooling air supplied from the axial fan and deflect a part of the cooling air to a direction away from the exhaust port, wherein a part of the cooling air that is not deflected by the shielding deflecting plate is introduced directly into the heat radiating unit, and wherein the shielding deflecting plate is arranged to extend at an angle which is not parallel to an axial direction of the axial fan, and the shielding deflecting plate is arranged at the angle with which a direction of the cooling air toward the one end surface is deflected to a side of another side surface facing the one side surface;

wherein the axial fan includes an impeller including a hub and a plurality of blades provided around the hub, and wherein the shielding deflecting plate is arranged to cover a part of the axial fan as viewed from an axial direction of the axial fan and has a width corresponding to a length from a base end to a front end of the blade, and the length not including the hub.

2. The light source device according to claim 1, wherein the shielding deflecting plate is provided to be extended from a mounting plate attached to the side of the one end surface of the axial fan.

3. The light source device according to claim 2, wherein the axial fan is fixed to a fixing plate, and the mounting plate clamps the axial fan in cooperation with the fixing plate.

4. The light source device according to claim 1, further comprising:

a plurality of axial fans configured to be provided in the casing and supply cooling air to the heat radiating unit, wherein the axial fan is one of the plurality of axial fans, and the plurality of axial fans are arranged in the casing side by side, and wherein the shielding deflecting plate is a single shielding deflecting plate that is provided between the plurality of axial fans and the heat radiating unit and shields a part of the cooling air supplied from the plurality of axial fans and deflects a part of the cooling air to a direction away from the exhaust port.

5. The light source device according to claim 1, wherein the exhaust port is formed in a rear half of a region located in the one side surface and facing the heat radiating unit.

6. The light source device according to claim 1, further comprising:

a rectifying plate extended from a periphery of the exhaust port in the one side surface toward the side of the one end surface in the casing and inclined with respect to the one side surface.

7. The light source device according to claim 1, wherein the exhaust port is a hole formed in the one side surface, and the exhaust ports are arranged in a honeycomb shape in the one side surface.

8. The light source device according to claim 1, wherein the axial fan is arranged at a position where a distance to the heat radiating unit is equal to or shorter than a distance to the other end surface.

9. The light source device according to claim 1, wherein the part of the cooling air in the heat radiating unit flows out of the heat radiating unit from only an exhaust port side, wherein the part of the cooling air supplied from the axial fan flows toward the exhaust port after flowing around to a side away from the exhaust port in the heat radiating unit, and wherein the exhaust port exhausts the cooling air toward the other end surface side outside the casing.

* * * * *